US011131449B2

(12) United States Patent
Huang

(10) Patent No.: US 11,131,449 B2
(45) Date of Patent: Sep. 28, 2021

(54) LIGHTING DEVICE

(71) Applicant: Liquidleds Lighting Corp., Taipei (TW)

(72) Inventor: David Huang, Taipei (TW)

(73) Assignee: Liquidleds Lighting Corp., Taipei (TW)

( * ) Notice: Subject to any disclaimer, the term of this patent is extended or adjusted under 35 U.S.C. 154(b) by 0 days.

(21) Appl. No.: 16/930,718

(22) Filed: Jul. 16, 2020

(65) Prior Publication Data

US 2021/0123590 A1 Apr. 29, 2021

(30) Foreign Application Priority Data

Oct. 25, 2019 (TW) ..... 108138727

(51) Int. Cl.

| | |
|---|---|
| ***F21V 29/50*** | (2015.01) |
| ***F21V 23/00*** | (2015.01) |
| ***F21V 23/06*** | (2006.01) |
| ***F21K 9/232*** | (2016.01) |
| ***F21V 3/04*** | (2018.01) |

(Continued)

(52) U.S. Cl.

CPC ..... *F21V 29/50* (2015.01); *F21K 9/232* (2016.08); *F21S 6/00* (2013.01); *F21V 3/02* (2013.01); *F21V 3/049* (2013.01); *F21V 23/002* (2013.01); *F21V 23/06* (2013.01); *F21Y 2103/33* (2016.08); *F21Y 2115/10* (2016.08)

(58) Field of Classification Search

CPC . F21V 3/02; F21V 23/06; F21V 3/049; F21V 23/002; F21K 9/232; F21K 9/66; F21S 6/00; F21Y 2103/33; F21Y 2115/10; F21Y 2107/90

See application file for complete search history.

(56) References Cited

U.S. PATENT DOCUMENTS

| | | | | |
|---|---|---|---|---|
| 7,784,967 | B2 * | 8/2010 | Lodhie | F21K 9/27 362/249.06 |
| 8,410,726 | B2 * | 4/2013 | Dau | H05B 45/10 315/312 |

(Continued)

FOREIGN PATENT DOCUMENTS

| | | |
|---|---|---|
| CN | 103162181 A | 6/2013 |
| CN | 103912798 A | 7/2014 |

(Continued)

*Primary Examiner* — Peggy A Neils

(74) *Attorney, Agent, or Firm* — Karin L. Williams; Alan D. Kamrath; Mayer & Williams PC

(57) ABSTRACT

The present invention relates to a lighting device including a light transmittable shell, a conductive unit and a light source. The light transmittable shell has an inner space and a mounting opening connected to the inner space. The light source is mounted around the mounting opening such that the LEDs in the light source are arranged along the edge of the mounting opening. The light from the light source transmits through the light transmittable shell from the edge of the mounting opening, leading to a glowing effect of the light transmittable shell, improving the lighting efficiency of the lighting device. Furthermore, the LEDs are distributed along the edge of the mounting opening and have direct contact with the flowing air in open space, so the heat-dissipation of the LEDs is effective enough without extra cooling components.

12 Claims, 15 Drawing Sheets

(51) Int. Cl.

| | |
|---|---|
| ***F21S 6/00*** | (2006.01) |
| ***F21V 3/02*** | (2006.01) |
| ***F21Y 103/33*** | (2016.01) |
| ***F21Y 115/10*** | (2016.01) |

(56) References Cited

U.S. PATENT DOCUMENTS

| | | | | |
|---|---|---|---|---|
| 8,550,655 | B1 * | 10/2013 | Wang | F21K 9/23 362/216 |
| 8,827,505 | B1 * | 9/2014 | Senkyr | F21V 17/104 362/351 |
| 9,194,546 | B1 | 11/2015 | Izradel | |
| 9,528,689 | B2 * | 12/2016 | Veres | F21V 29/70 |
| 9,657,917 | B2 * | 5/2017 | McCavit | H05B 45/10 |
| 9,945,532 | B2 | 4/2018 | Huang | |
| 10,322,200 | B2 * | 6/2019 | Schramm | A61L 9/03 |
| 2011/0163683 | A1 | 7/2011 | Steele et al. | |
| 2011/0309735 | A1 | 12/2011 | Parker et al. | |
| 2012/0081880 | A1 | 4/2012 | Narendran et al. | |
| 2012/0139403 | A1 | 6/2012 | Johnston et al. | |
| 2013/0039058 | A1 | 2/2013 | Yun et al. | |
| 2014/0268744 | A1 * | 9/2014 | Nourbakhsh | F21V 3/049 362/235 |
| 2014/0314571 | A1 * | 10/2014 | Wu | F21V 33/0096 416/5 |
| 2017/0184282 | A1 | 6/2017 | Chen et al. | |

FOREIGN PATENT DOCUMENTS

| | | | |
|---|---|---|---|
| DE | 202016008632 | U1 | 10/2018 |
| EP | 3301354 | A2 | 4/2018 |
| TW | 201621210 | A | 6/2016 |
| TW | M531546 | U | 11/2016 |

* cited by examiner

LIGHTING DEVICE

CROSS-REFERENCE TO RELATED APPLICATIONS

This application claims the priority benefit of TW application serial No. 108138727 filed on Oct. 25, 2019. The entirety of the above-mentioned patent application is hereby incorporated by reference herein and made a part of specification.

BACKGROUND OF THE INVENTION

1. Field of the Invention

The present invention relates to a lighting device, particularly to a Light Emitting Diode (LED) lighting device with a light transmittable shell.

2. Description of the Prior Art

With reference to FIG. 13, EP3188264B1 recites an LET) lighting device, including an LED light source 91, a lamp base 92, a supporting element 93, and a lamp cover 94. The lamp cover 94 and the lamp base 92 are connected to form an enclosed accommodation space, in which the light source 91 and the supporting element 93 are mounted. The light source 91 is fixed at the center of the enclosed accommodation space with the supporting of the supporting element 93. The light source 91 is mounted in the enclosed accommodation space which has no connection to any open space. Therefore, there is no air circulation around the light source 91, and the heat-dissipation effect to the light source 91 is poor. Besides, the lamp cover 94 is simply a shell for the light source, and the light from the light source 94 is transmitted directly through the lamp cover 94. The supporting element 93 at the middle of the device is also not visually aesthetic.

With reference to FIG. 14, EP3301354A2 recites an LED lamp, including an LED light bar 95 and a protective cover 96 in a tubular shape. The light bar 95 is mounted inside the protective cover. The main technical feature in this patent is to reduce the size of the protective cover, and therefore reduce the distance between the light bar 95 and the open space to improve the heat-dissipation effect. However, the protective cover 96 still forms an enclosed space in which the light bar 95 is mounted, and the gap between the light bar 95 and the wall of the protective cover 96 may still block the heat from escaping. Besides, the tube-shaped protective cover 96 is slender and curved, which makes it fragile in structure and is not suitable for common lamp cover material such as glass.

With reference to FIG. 15, US20110163683A1 recites an LED lamp including a light strip 97, a lamp base 98, and a lamp cover 99. Similarly, the lamp cover and the lamp base form an enclosed accommodation space, and the light strips are mounted along the inner surface of the lamp base. The main technical feature of said application is the light strips mounted on the inner surface of the lamp base so that the heat generated by the LEDs on the light strips may be conducted to the outside directly through the wall of the lamp cover. However, the heat may still accumulate in the accommodation space and cause temperature rise. Besides, the LEDs distributed on the surface on the bulb may not be visually aesthetic.

To sum up, the heat-dissipation efficiency is a main concern in the design of an LED lighting device. However, the LED lighting devices of the prior art are restricted by the traditional form and traditional manufacturing technique of light bulbs, and no advanced technical feature that overcomes the aforementioned problem has appeared. Therefore, the conventional LED lighting device needs to be further improved.

SUMMARY OF THE INVENTION

Since the LED lighting devices of the prior arts is unable to overcome the problems of heat-dissipation efficiency and exterior designing, the present invention provides a lighting device, the lighting device including a light transmittable shell, a conductive unit, and a light source. The light transmittable shell has a mounting opening and an inner space, the mounting opening communicating with the inner space. The light source includes a plurality of light emitting diodes (LED), and the light source is mounted around the mounting opening, such that the LEDs are arranged along the edge of the mounting opening. The conductive unit is mounted on an inner surface of the light transmittable shell, and has two opposite ends that are connected to the power source and the light source respectively.

The light transmittable shell is made of light transmittable material such as transparent glass, frosted glass, or acrylics. Since the light source is mounted around the mounting opening, the shape and the lighting direction of the light source a determined mainly according to the shape and facing direction of the mounting opening. The light from the light source is not only radiated directly toward the outside of the mounting opening, but also is transmitted through the light transmittable shell and scatters toward the other side of the mounting opening, or is transmitted across the inner space and through the light transmittable shell, leading to a glowing effect of the light transmittable shell. The light from the light source can be emitted in all directions around the lighting device, therefore raising light utilization efficiency. The light emitted directly toward the outside of the mounting opening is the main illumination, and the light emitted to the opposite direction and other directions may provide indirect illumination or environmental illumination. The shape of the light transmittable shell may be spherical, hemispherical, cubical or planar, etc., and the shape of the lighting device is not restricted to any limitation.

Furthermore, since the light source is mounted on the light transmittable shell, the light transmittable shell is the supporting element of the light source, and there is no need for an extra supporting element. Without the extra supporting element, the material cost and assembly cost for the manufacture of the lighting device are lowered, and the lighting device may have a simplified appearance.

Furthermore, since the LEDs are arranged along the edge of the mounting opening and the mounting opening is connected to the inner space and the outside of the lighting device, each LED is in contact with the air flowing between the inner space and the outside, and can be cooled by the contacting light transmittable shell or by the flowing air by convection. Compared to the LED light bulb of the prior arts in which the LEDs are mounted compactly in the middle or on the inner surface of the enclosed protective shell, air can flow through the mounting opening into the inner space of the lighting device of the present invention. Therefore, the LEDs of the lighting device of the present invention have direct contact with ambient air, thereby ensuring an improved heat-dissipation effect.

To sum up, the light source is mounted around the mounting opening of the light transmittable shell, so that the light from the light source may be transmitted through the light transmittable shell to provide illumination. The lighting source doesn't need another supporting element to maintain the position and shape, and therefore the components of the lighting device are simplified. The LEDs in the light source are arranged along the edge of the opening, so that the density of the LEDs is low and the LEDs have direct contact with flowing air. The heat-dissipation efficiency is good enough such that the lighting device doesn't need an extra cooling component. Without an extra cooling component, the design of the lighting device can be simplified, and the cost of manufacture is also lowered.

DETAILED DESCRIPTION OF THE INVENTION

Figure 1:
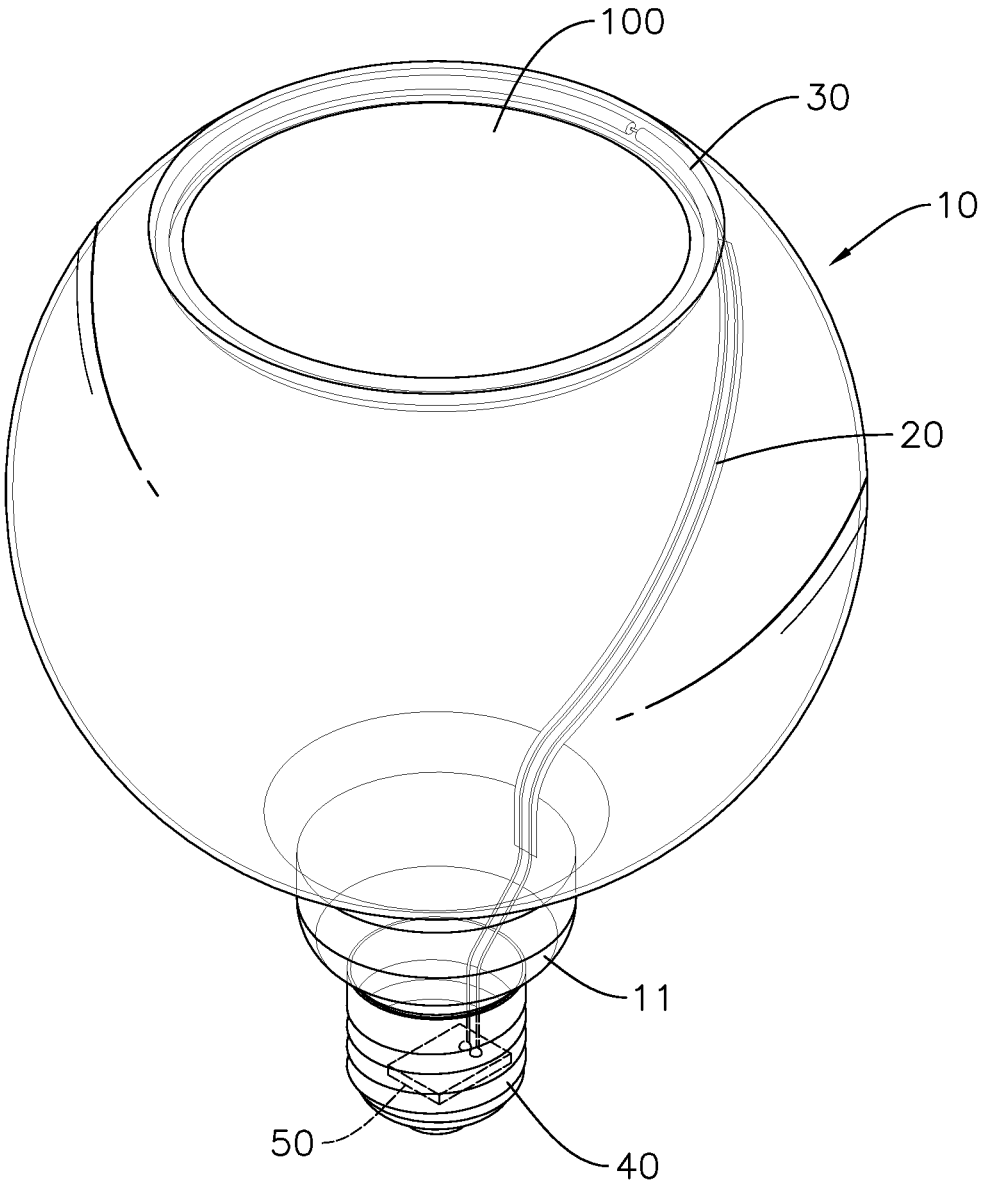
FIG. 1 is a perspective view of a lighting device of the present invention.

With reference to FIG. 1, the present invention provides a lighting device, including a light transmittable shell 10, a conductive unit 20 and a light source 30. The light transmittable shell 10 has a mounting opening 100 and an inner space, and the inner space communicates with the mounting opening 100. The light source 30 includes a plurality of light emitting diodes (LEDs), and the light source 30 is mounted around the mounting opening 100, such that the LEDs are arranged along the edge of the mounting opening 100.

The conductive unit 20 is mounted on an inner surface of the light transmittable shell 10, having two opposite ends that connect to an external power source and the light source 30 respectively. The conductive unit 20 may be copper wires that are fixed to the inner surface with a transparent insulation tape.

Preferably, the light transmittable shell 10 has a connecting end 11, and the lighting device further includes a lamp cap 40 and a power unit 50. The lamp cap 40 is connected to the connecting end 11, and the power unit 50 is mounted inside the lamp cap 40 and electrically connected to the lamp cap 40. When the lighting device is connected to the external power source, the power unit 50 is electrically connected to the external power source through the lamp cap 40, a first end of the conductive unit 20 is connected to the power unit 50 through the lamp cap 40, a second end of the conductive unit 20 extends along the inner surface of the light transmittable shell 10 toward the mounting opening 100, and the second end of the conductive unit 20 is electrically connected to the light source 30.

In the embodiment, the lamp cap 40 is mounted on the light transmittable shell 10 and is connected to an external power source such as a lamp base. The power unit 50 converts the power from the external power source and provides appropriate power to the light source 30.

In another embodiment, the lighting device may not include the lamp cap 40, and is connected to an external power supply module that includes the power unit 50. The first end of the conductive unit 20 is connected to the external power supply module and the power unit 50 within the external power supply module. The first end of the conductive unit 20 may extend through the connecting end 11 of the light transmittable shell 10 to reach the power supply module.

Figure 2:
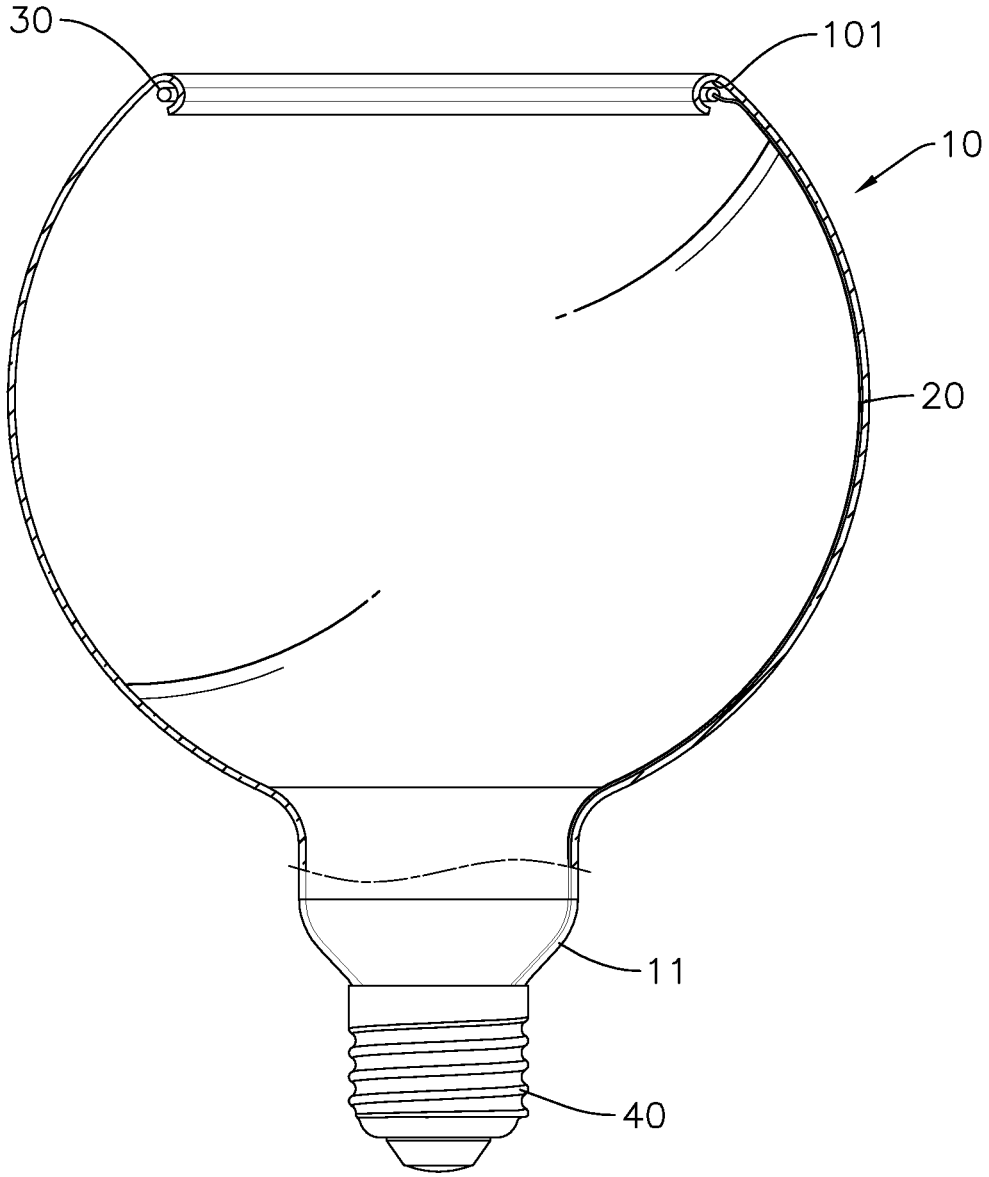
FIG. 2 is a partial cross sectional view of a lighting device of a first embodiment of the present invention.

With reference to FIG. 2, in a first embodiment of the present invention, the edge of the mounting opening 100 is curved toward the inner space and forms an accommodation slot 101. The light source 30, which might be covered with an insulation tube such as rubber, is mounted in the accommodation slot 101. Preferably, the accommodation slot 101 is glued with transparent insulation gel, so that the light source is fixed tightly in the accommodation slot 101 and is insulated appropriately.

The light transmittable shell 10 can come in different shapes and sizes as required. The light transmittable shell 10 may be a sphere, a hemisphere, an ellipsoid, or a cube in shape. Furthermore, the connecting end 11 and the mounting opening 100 can also be placed in different relative positions or directions, so that the lighting devices can provide different options in terms of visual effect and main illuminating directions.

Figure 3:
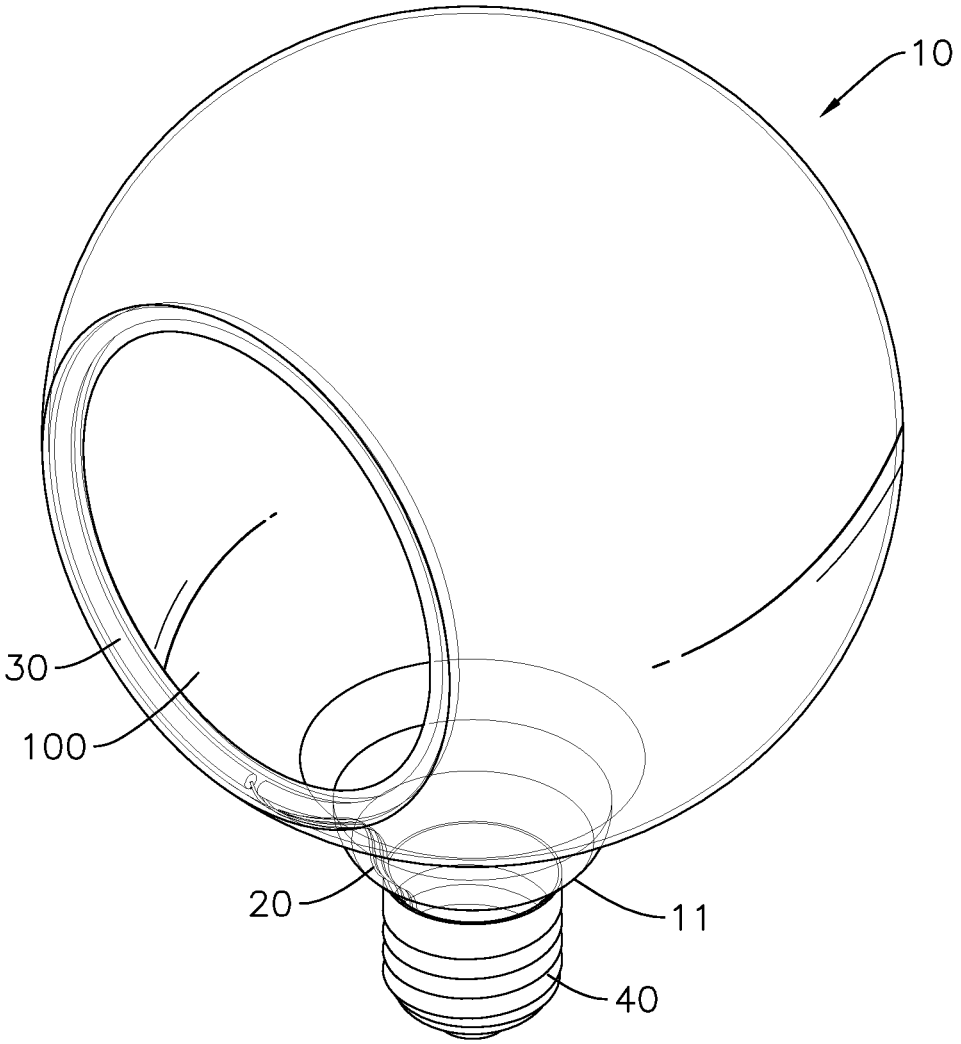
FIG. 3 is a perspective view of a second embodiment of a lighting device of the present invention.

For example, with reference to FIGS. 1 to 3, the light transmittable shell 10 is spherical, and the mounting opening 100 is a round opening.

With reference to FIG. 1, in one embodiment, the lamp cap 40 is mounted on the outer surface of the light transmittable shell 10. In one aspect, the lamp cap 40 may be directly connected to the surface of the light transmittable shell 10 by gluing. In another aspect, as shown in FIG. 1, the connecting end 11 of the light transmittable shell 10 is a protruding part of the light transmittable shell 10 that is on the outside of the lighting device, and the lamp cap 40 is connected to the connecting end 11, such that the lamp cap 40 and the mounting opening 100 are facing opposite directions. The lighting device of the present embodiment may be suitable for installation at a lamp base on the ceiling such that the light transmittable shell 10 is suspended, the mounting opening 100 is facing the space underneath, and the light source 30 will be mainly illuminating the space underneath. The light transmitting through the light transmittable shell 10 to the other directions may light up the ceiling and provide the space with the reflected and indirect light source 30.

With reference to FIG. 3, in a third embodiment, the angle between the directions that the mounting opening 100 and the lamp cap 40 are facing is less than 180 degrees for example 90 degrees. That is, the mounting opening 100 is at a side face of the lamp cap 40. The lighting device of the present embodiment, for instance, can be installed at a lamp base located at a wall, such that the mounting opening 100 is facing downward to provide main illumination to the space underneath. The light device may also be hung by a pendant cable from the ceiling such that the opening 100 is facing the side to provide illumination to the wall for example.

Figure 4:
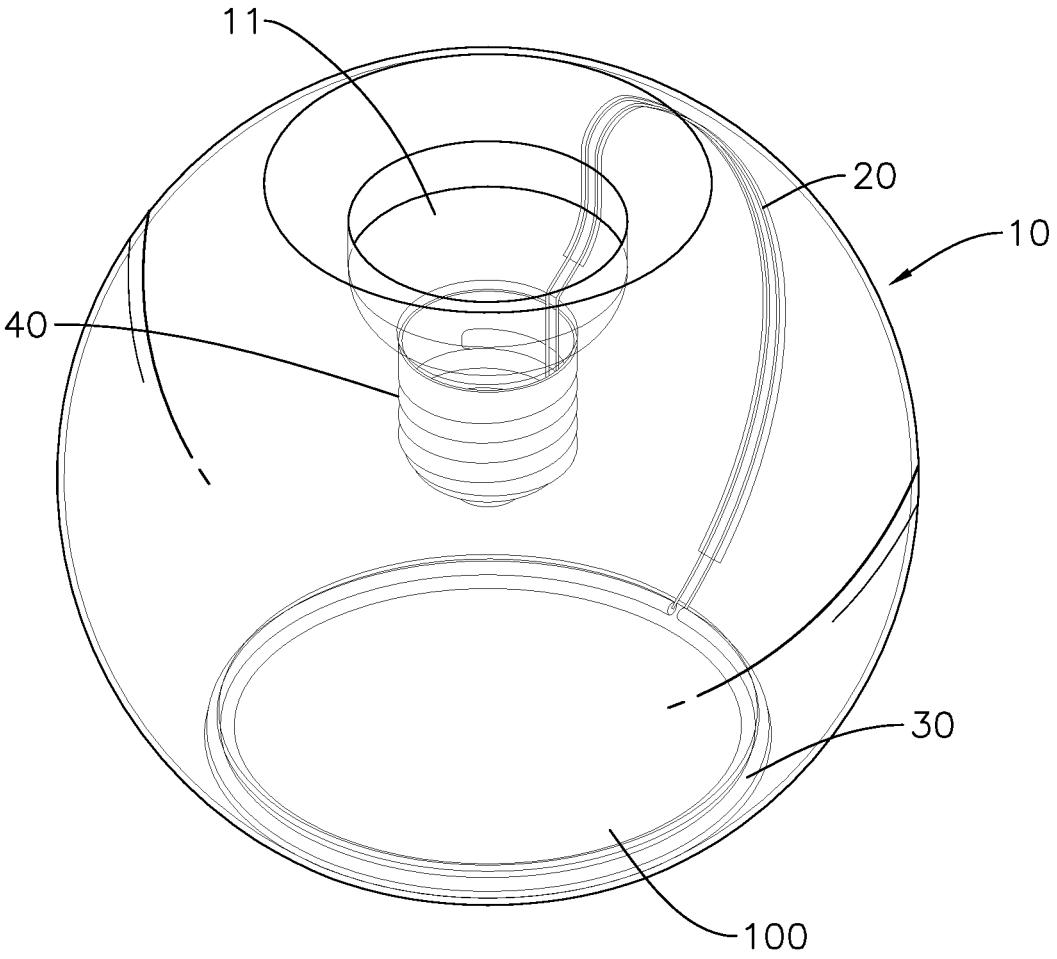
FIG. 4 is a perspective view of a third embodiment of a lighting device of the present invention.
Figure 5:
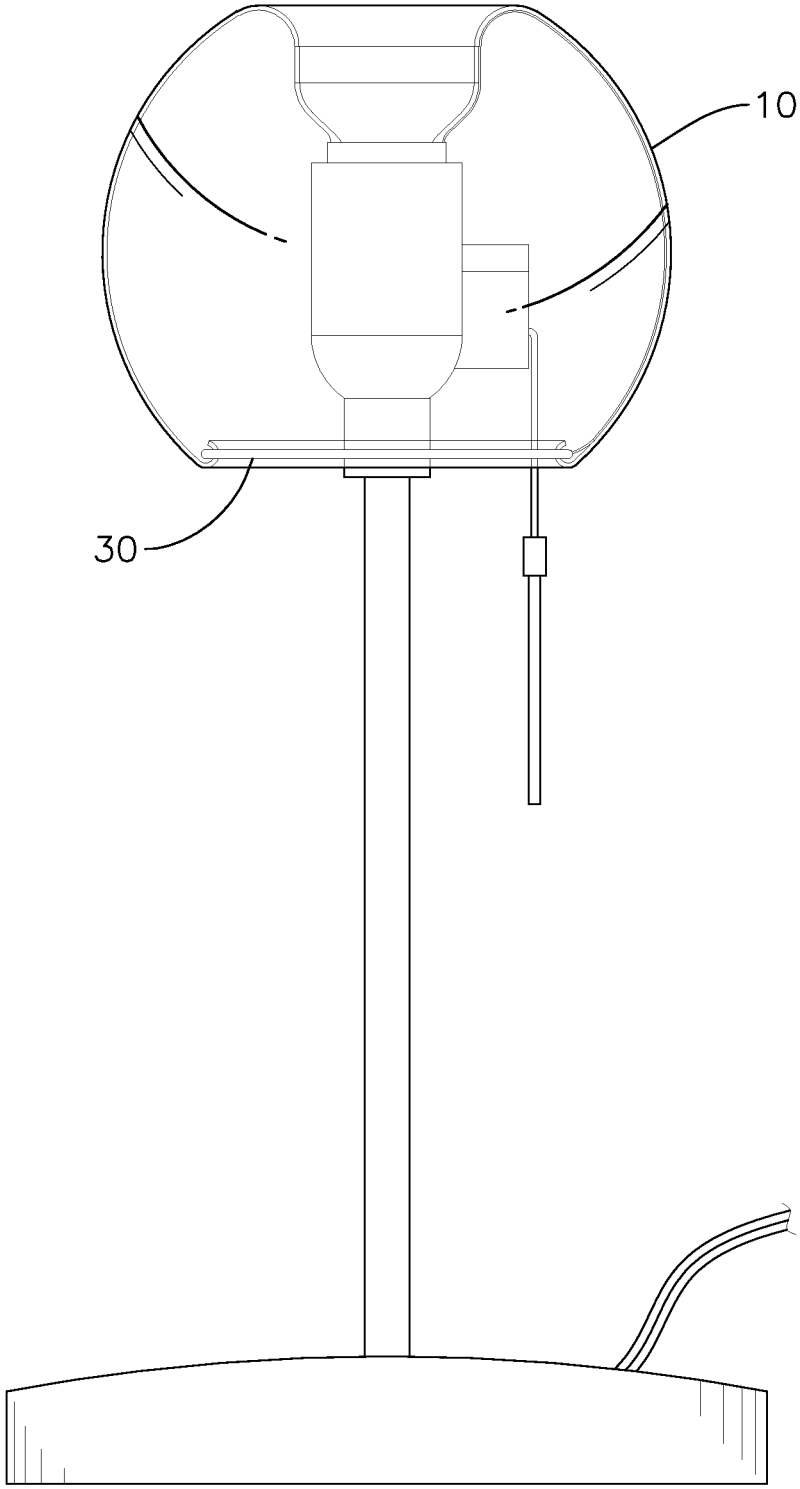
FIG. 5 is an operational front side view of a lighting device of the present invention.

In a third embodiment of the present invention, the lamp cap 40 is mounted in the inner space of the light transmittable shell 10. In one aspect, the lamp cap 40 may be directly connected to the inner surface of the light transmittable shell 10 by gluing. In another aspect, as shown in FIG. 4, the connecting end 11 of the light transmittable shell 10 is a protruding part of the light transmittable shell 10 on the inner surface of the lighting device, and the lamp cap 40 is placed in the inner space connected to the connecting end 11, so that the lamp cap 40 is facing the mounting opening 100 from the inner space. With reference to FIG. 5, the lighting device of the present embodiment may be applied to a desk lamp. Preferably, the first end of the conductive unit 20 extends to an inner surface of the connecting end 11 to connect to the power unit 50 inside the lamp cap 40.

Figure 6:
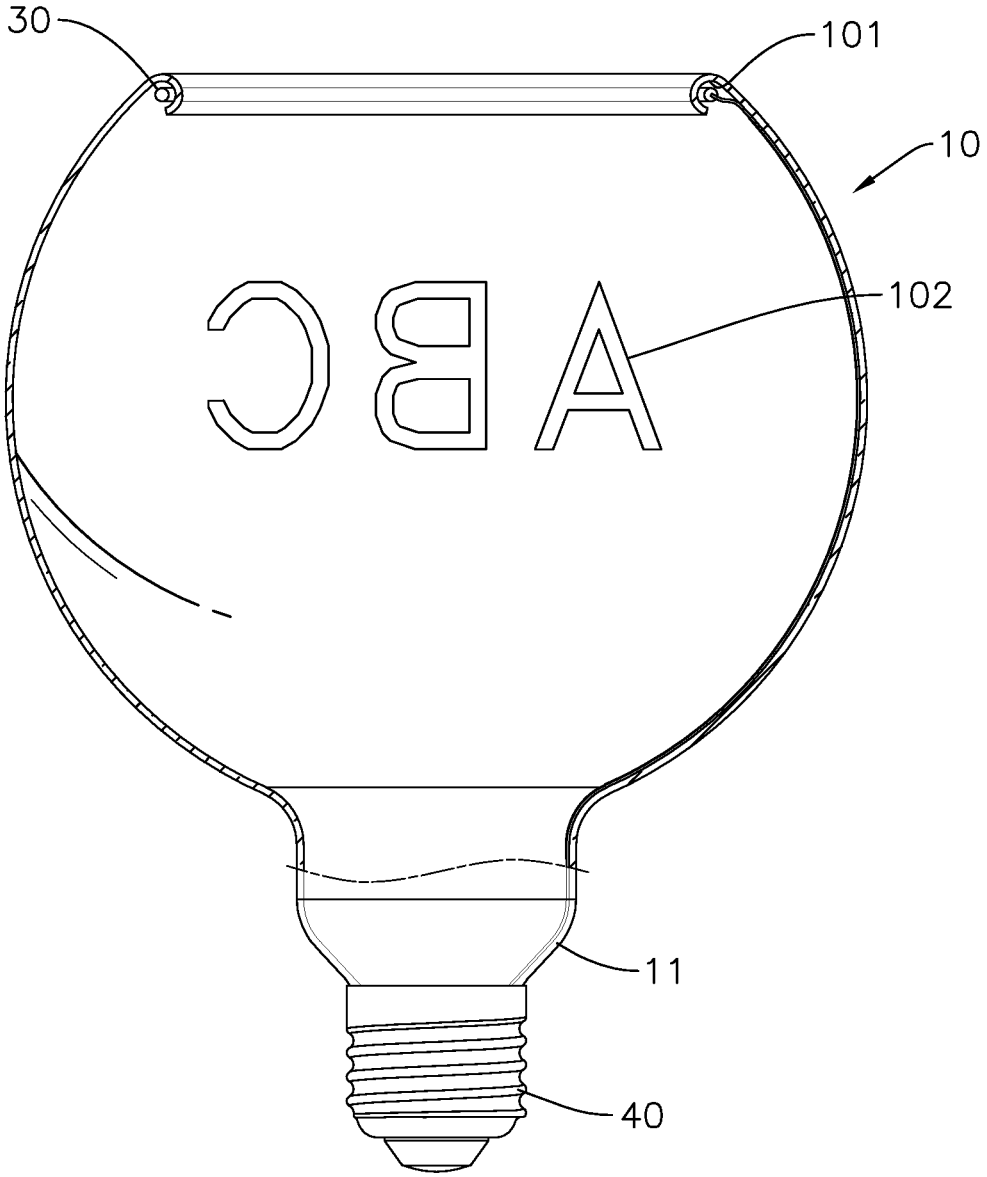
FIG. 6 is a partial cross sectional view of a fourth embodiment of a lighting device of the present invention.

With reference to FIG. 6, in a fourth embodiment of the present invention, the light transmittable shell 10 may further include patterns 102. The patterns 102 may be formed on the light transmittable shell 10 by laser engraving, polishing, or spray coating. When the lighting device lights up, the light transmitted through the light transmittable shell 10 and scattering through the patterns 102 may highlight the patterns 102 and provide visual effects. Besides, in another embodiment, the light transmittable shell 10 may also include at least one through hole. The at least one through hole provides a window for better thermal convection and ensures the cooling of the light source 30. When the light source 30 lights up, the light transmitted through the light transmittable shell 10 may also scatter through the edge of a through hole and provide further visual effects.

Figure 7:
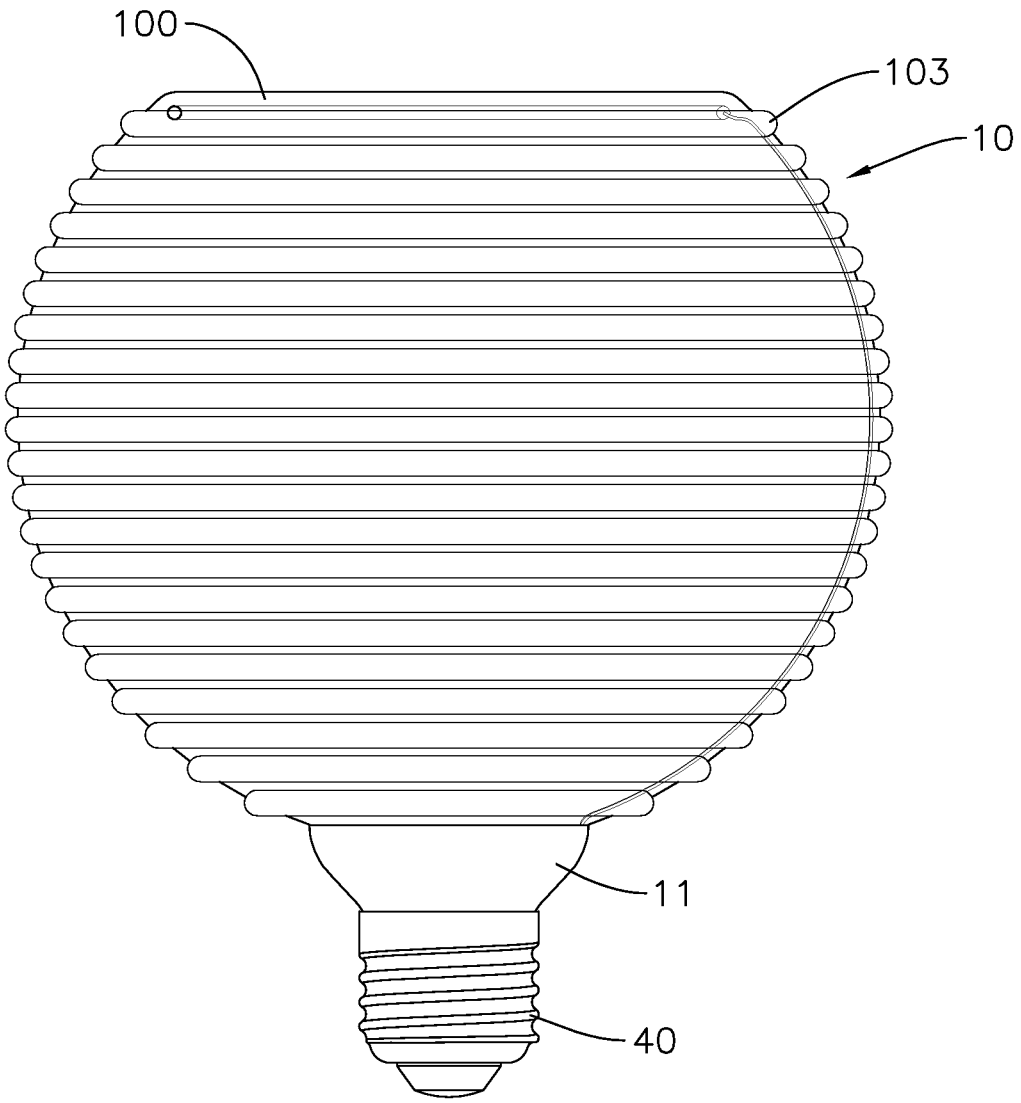
FIG. 7 is a perspective view of a fifth embodiment of a lighting device of the present invention.

With reference to FIG. 7, in a fifth embodiment of the present invention, the light transmittable shell 10 further comprises at least one protruding rib 103 that protrudes from the outer surface or the inner surface of the light transmittable shell 10. That is, the protruding rib 103 is a protrusion of the light transmission shell 10 from either surface. For instance, the protruding rib 103 may be parallel to the mounting opening 100, or may intersects the mounting opening 100 at a specific angle. The protruding rib 103 may be formed in any shape, pattern and size. When the light transmits through the light transmittable shell and scatters through the protruding rib 103, a decent lighting visual effect is presented.

Figure 8:
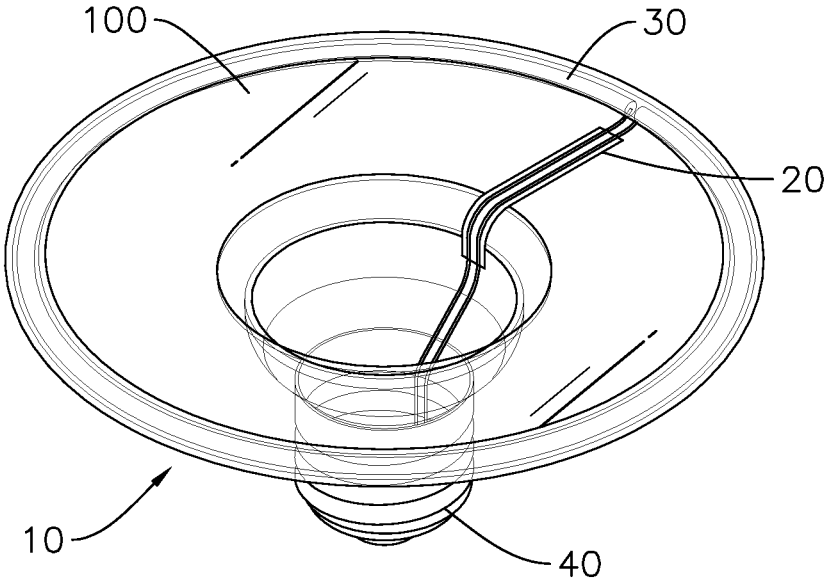
FIG. 8 is a perspective view of a sixth embodiment of a lighting device of the present invention.

With reference to FIG. 8, in a sixth embodiment of the present invention, the light transmittable shell 10 is a planar shell, or a slightly curved shell that is almost flat as a plate. In this case, the mounting opening 100 of the light transmittable shell 10 is the edge of the planar shell.

Figure 9:
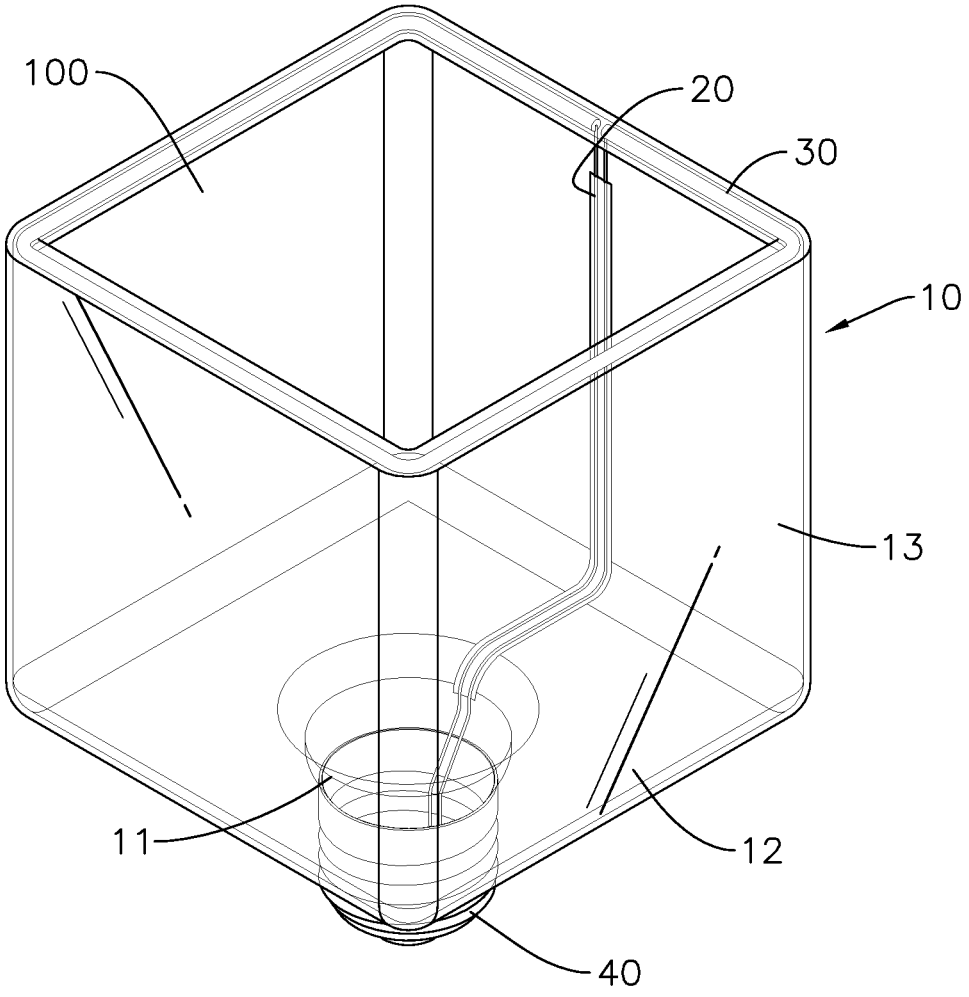
FIG. 9 is a perspective view of a seventh embodiment of a lighting device of the present invention.
Figure 10:
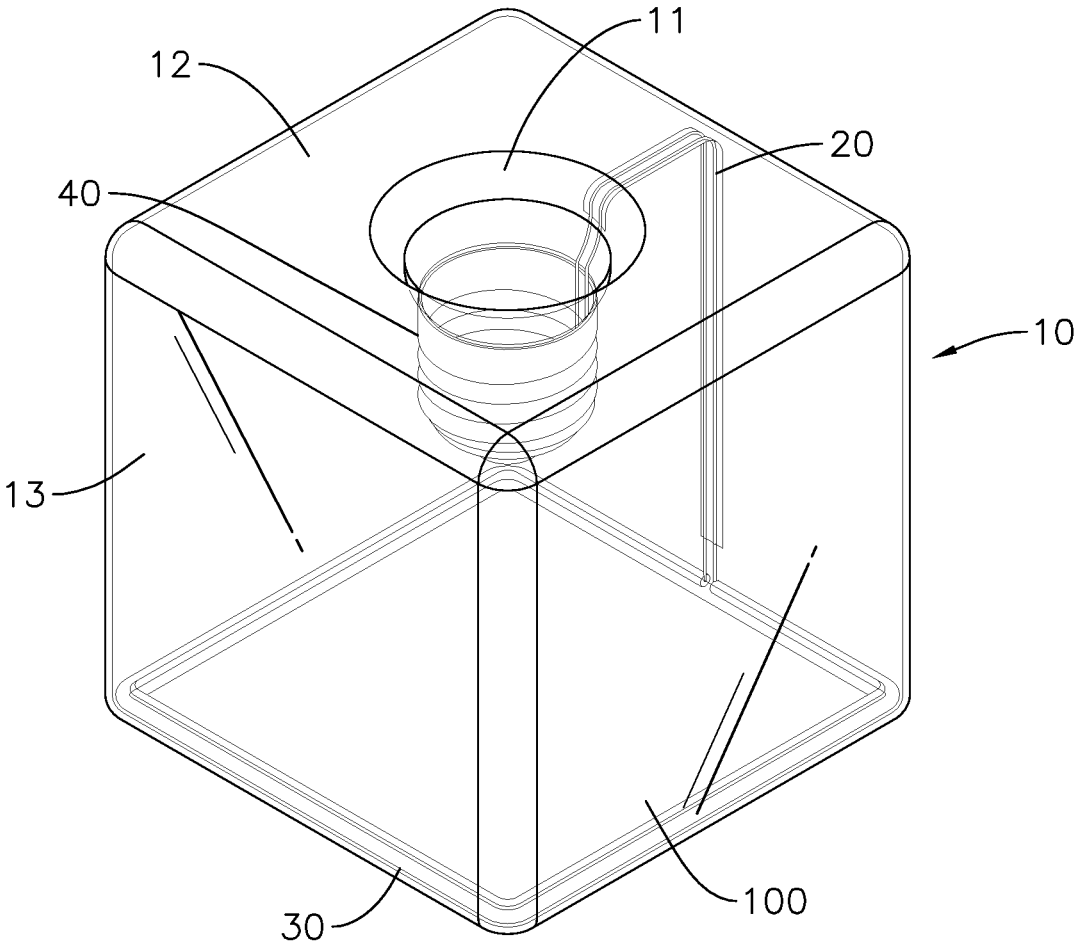
FIG. 10 is a perspective view of an eighth embodiment of a lighting device of the present invention.

With reference to FIG. 9 and FIG. 10, in a seventh and an eighth embodiment of the present invention, the light transmittable shell 10 is a cubical shell, and the mounting opening 100 is a square opening. The light transmittable shell 10 includes a bottom wall 12 and a surrounding wall 13. One end of the surrounding wall 13 is connected to the edge of the bottom wall 12, and an opposite end of the surrounding wall 13 forms the mounting opening 100 of the light transmittable shell 10. The surrounding wall 13 and the bottom wall 12 define the inner space of the light transmittable shell 10, and the connecting end 11 is formed on the bottom wall 12. FIG. 8 shows the sixth embodiment in which the connecting end 11 is a protrusion formed on the outside surface of the bottom wall 12. FIG. 9 shows the seventh embodiment in which the connecting end 11 is a protrusion formed on the inner surface in the inner space.

Figure 11:
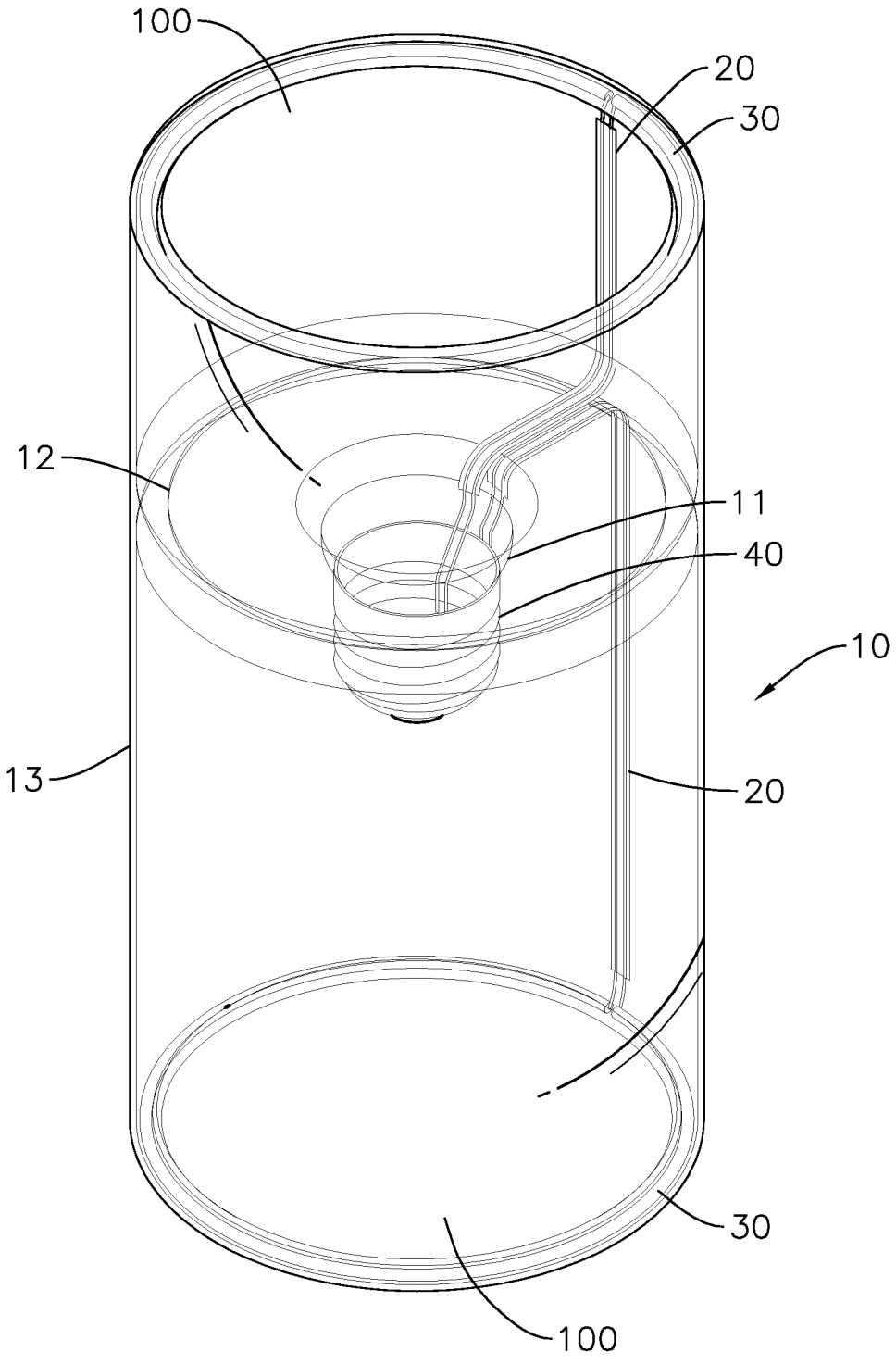
FIG. 11 is a perspective view of a ninth embodiment of a lighting device of the present invention.
Figure 12:
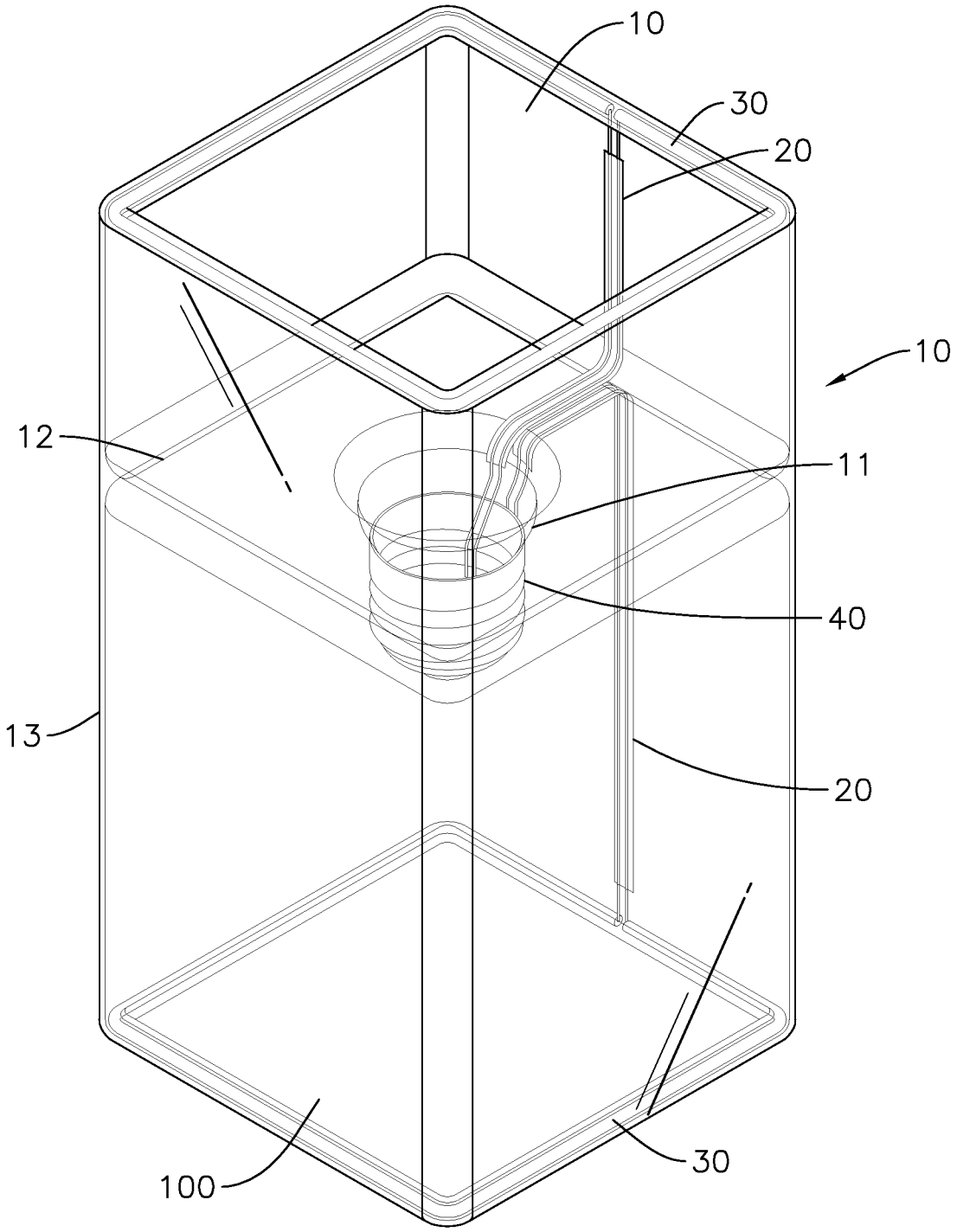
FIG. 12 is a perspective view of a tenth embodiment of a lighting device of the present invention.
Figure 13:
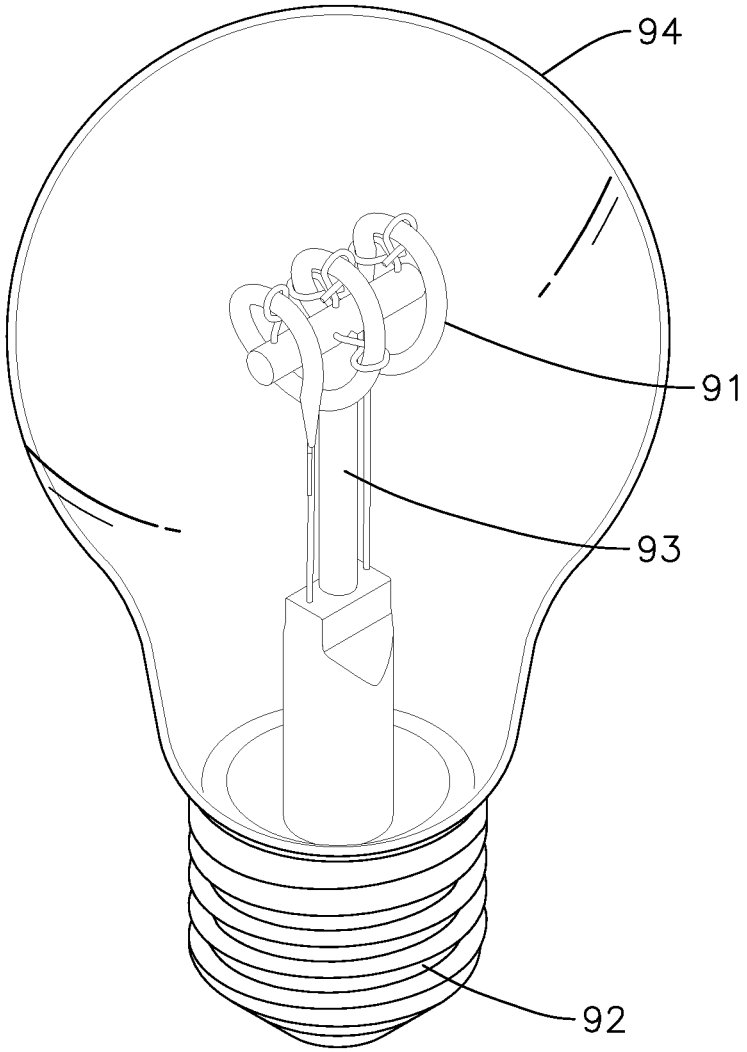
FIG.13 PRIOR ART
FIG. 13 is a perspective view of a conventional LED light bulb.
Figure 14:
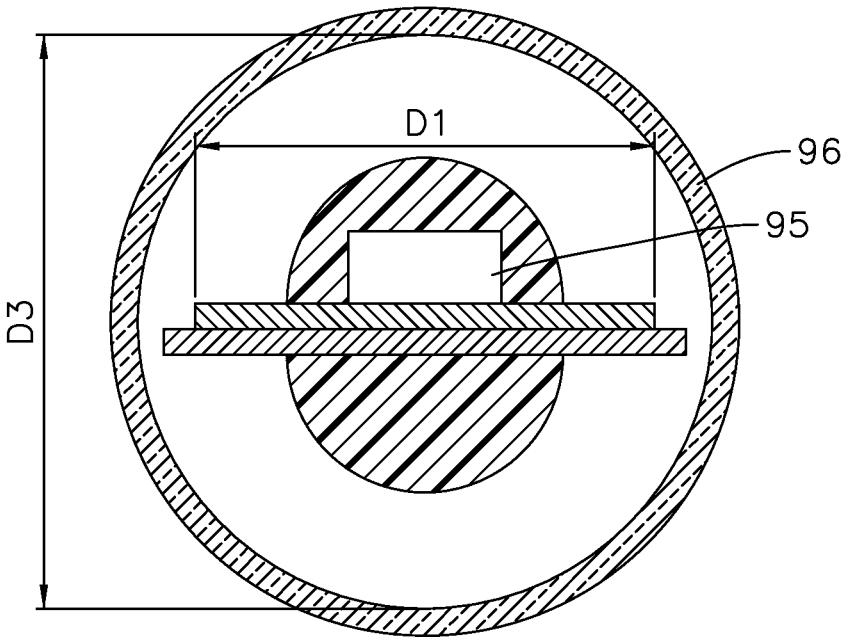
FIG.14 PRIOR ART
FIG. 14 is a cross sectional view of another conventional LED light bulb.
Figure 15:
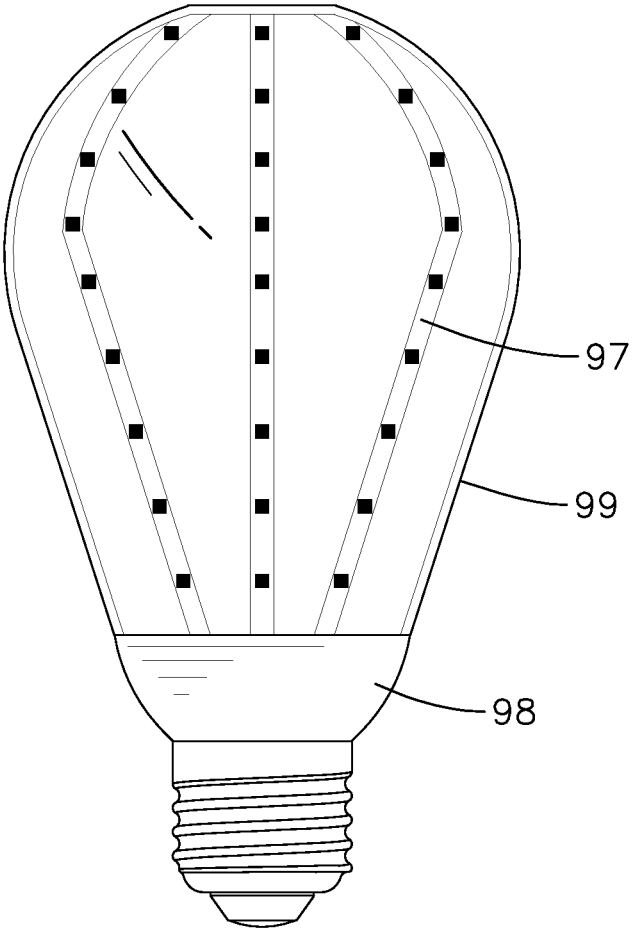
FIG.15 PRIOR ART
FIG. 15 is a front side view of still another conventional LED light bulb of another prior art.

With reference to FIGS. 11 and 12, in the ninth and tenth embodiments of the present invention, the light transmittable shell 10 includes two mounting openings 100, and the lighting device includes two light sources 30 that are mounted around the two mounting openings 100. The light transmittable shell 10 includes a surrounding wall 13 and a bottom wall 12. The surrounding wall 13 has two opposite ends, and the two mounting openings 100 are formed at the two opposite ends of the surrounding wall 13 of the light transmittable shell 10. The edge of the bottom wall 12 is connected to the inner surface of the surrounding wall 13, and the connecting end 11 is formed on one side of the bottom wall 12, so that the lamp cap 40 is facing toward one of the mounting openings 100. The two light sources are each electrically connected to the power unit 50 in the lamp cap 40 through one respective conductive unit 20. The two conductive units 20 are mounted on the inner surface of the surrounding wall 13 and the two sides of the bottom wall 12 to connect to the power unit 50 in the lamp cap 40.

In the ninth embodiment of the present invention, as shown in FIG. 11, the surrounding wall 13 is a cylindrical wall. In the ninth embodiment of the present invention, as shown in FIG. 12, the surrounding wall 13 is a rectangular prism wall.

Preferably, the light source 30 is a soft LED light strip, a hard LED light strip, or a double-sided LED light strip. The light source 30 is shaped according to the shape of the mounting opening 100. The double-sided LED light strip may be an LED light strip having two opposite sides, and the light of the LED light strip can be emitted from the both sides of the LED light strip, such as the LED light strip recited in the publication of TW201621210. The light emitted from such LED light source 30 will not be blocked by the substrate and is able to provide effective illumination in all directions. Utilizing such LEI) light source 30 in the present lighting device not only enables the light to be transmitted directly outside the mounting opening 100 effectively, but also provides a better glowing visual effect as the light is transmitted through the light transmittable shell 10.

What is claimed is:

1. A lighting device, electrically connected to an external power source, characterized in that the lighting device comprises:

a light transmittable shell, constructed as one piece and having a mounting opening and an inner space, the mounting opening communicating with the inner space;

a light source, comprising a plurality of light emitting diodes (LEDs), wherein the light source is mounted around the mounting opening such that the LEDs are arranged along an edge of the mounting opening; and a conductive unit, mounted on an inner surface of the light transmittable shell, and having a first end and a second end, wherein the first end is connected to the external power source, and the second end is connected to the light source respectively, wherein the edge of the mounting opening curves toward the inner space and forms an accommodation slot, and wherein the light source is mounted in the accommodation slot.

2. The lighting device as claimed in claim 1, wherein the light transmittable shell comprises a connecting end; the lighting device further comprising:

a lamp cap, connecting to the connecting end;

a power unit, mounted in the lamp cap and electrically connected to the lamp cap, wherein the power unit is electrically connected to the external power source through the lamp cap;

wherein an end of the conductive unit is connected to the power unit through the lamp cap, and another end of the conductive unit extends along the inner surface of the light transmittable shell to the mounting opening and is electrically connected to the light source.

3. The lighting device as claimed in claim 2, wherein the lamp cap is mounted in the inner space.

4. The lighting device as claimed in claim 2, wherein the lamp cap is mounted on an outside surface of the light transmittable shell.

5. The lighting device as claimed in claim 1, wherein the light transmittable shell is a spherical shell, and the mounting opening is circular in shape.

6. The lighting device as claimed in claim 1, wherein the light transmittable shell is a cubical shell, and the mounting opening is square in shape.

7. The lighting device as claimed in claim 3, wherein the connecting end is a protruding part formed on the inner surface of the light transmittable shell;

wherein the first end of the conductive unit extends along the inner surface of the light transmittable shell to the lamp cap, and the second end of the conductive unit extends between the inner surface of the light transmittable shell and the lamp cap and connects to the power unit.

8. The lighting device as claimed in claim 1, wherein the light transmittable shell is a planar shell, and the mounting opening is the edge of the shell.

9. The lighting device as claimed in claim 2, comprising two light sources, and the light transmittable shell comprising two mounting openings; wherein the light transmittable shell comprises a surrounding wall, having two opposite ends, and the two mounting openings are each respectively formed at the two opposite ends of the light transmittable shell;

a bottom wall, an edge of the bottom wall is connected to an inner surface of the surrounding wall, and the connecting end is a protruding part formed on one side of the bottom wall.

10. The lighting device as claimed in claim 1, wherein the light transmittable shell further comprises:

a pattern; wherein the pattern is formed on the light transmittable shell by laser engraving, polishing, or spray coating; wherein when the light source lights up, light is transmitted through the light transmittable shell and scatters from the pattern.

11. The lighting device as claimed in claim 1, wherein the light transmittable shell further comprises a protruding rib that protrudes from the inner surface or an outside surface of the light transmittable shell.

12. The lighting device as claimed in claim 1, wherein the light source is an LED light strip having two opposite sides, wherein light is emitted from the two opposite sides.

* * * * *